219-121
12/31/85 XR 4,561,358

United States Patent [19]

Burgess

[11] Patent Number: 4,561,358

[45] Date of Patent: Dec. 31, 1985

[54] APPARATUS FOR CONVEYING ARTICLES THROUGH AN IRRADIATION BEAM

[75] Inventor: Robert G. Burgess, Smithtown, N.Y.

[73] Assignee: Radiation Dynamics, Inc., Melville, N.Y.

[21] Appl. No.: 510,722

[22] Filed: Jul. 5, 1983

[51] Int. Cl.[4] ..... B61B 3/00

[52] U.S. Cl. ..... 104/89; 104/96; 105/156; 219/121 EB; 219/121 EX

[58] Field of Search ..... 104/89, 91, 96, 171; 105/156; 118/729, 730; 219/121 EB, 121 EM, 121 EX, 121 EY; 198/377

[56] References Cited

U.S. PATENT DOCUMENTS

| | | | |
|---|---|---|---|
| 1,725,264 | 8/1929 | Garnett | 105/156 |
| 2,187,073 | 1/1940 | Bishop . | |
| 2,546,374 | 3/1951 | Rayburn . | |
| 2,586,264 | 2/1952 | Rose | 104/91 |
| 3,195,473 | 7/1965 | Dehne | 104/91 |
| 3,366,221 | 1/1968 | Preisig | 198/377 |
| 3,401,249 | 9/1968 | Schleich et al. | 219/121 |
| 3,995,745 | 12/1976 | Chambers | 198/377 |
| 4,180,152 | 12/1979 | Sefcik | 198/377 |
| 4,284,033 | 8/1981 | del Rio | 118/730 |

*Primary Examiner*—Robert B. Reeves
*Assistant Examiner*—Dennis C. Rodgers
*Attorney, Agent, or Firm*—Howard L. Rose

[57] ABSTRACT

Apparatus for conveying articles of length L through an irradiation beam of width B, where L substantially exceeds B. The articles are supported on carriers which are suspended between and more along two tracks positioned with the beam therebetween. The carriers travel for a first distance with the articles extending transversely relative to the two tracks to permit close-packing of the carriers as they move toward the beam. As each carrier approaches the beam, it is reoriented relative to the two tracks to increase the exposure angle defined between (a) the carrier dimension along which the article extends and (b) the width of the beam. After exiting from under the beam each carrier is preferably returned to a transverse travelling orientation relative to the two tracks. The invention further includes the directing of carriers along monorails enroute to and/or from the two tracks.

20 Claims, 5 Drawing Figures

APPARATUS FOR CONVEYING ARTICLES THROUGH AN IRRADIATION BEAM

FIELD OF THE INVENTION

The present invention relates to apparatus for conveying articles supported by carriers through a beam of irradiation.

BACKGROUND OF THE INVENTION

In the past it has been taught in specific applications that article-supporting carriers may be moved along a desired path and may be switched in relative position between side-by-side and end-to-end relationships.

One such application involves the moving of carriers in an end-to-end relationship enroute to and from an oven which processes articles on the carriers. As the carriers approach the oven, the carriers are positioned in side-by-side series to pass through the oven in a closely packed arrangement. The switching of relative positioning between adjacent carriers is effectuated by disposing each carrier between two trolleys and running the trolleys either (a) along a monorail to achieve an end-to-end orientation for a carrier or (b) along two parallel tracks to achieve a sideways orientation for a carrier. This arrangement, shown in U.S. Pat. No. 3,195,473, provides that each carrier at all times extend lengthwise between the two trolleys.

While addressing the questions of grouping carriers together for processing in an oven, U.S. Pat. No. 3,195,473 does not consider the problem of processing an article which may be significantly longer than the oven is wide. Similarly, the patent does not suggest how other processing devices of limited width might process elongated articles which extend beyond the area covered by such other devices.

This problem is particularly significant where an irradiation beam of a given beam scan width B is to irradiate an article or articles extending across a length L on a carrier, where L is significantly larger than B.

In environments where open floor space is sought, it is desirable to suspend the carriers from overhead tracks. In suspending carriers to be irradiated by a beam, a further problem arises regarding how to suspend the carriers without interfering with the beam. In applying the teachings of the past, elongated articles might be oriented in a cross-wise or lateral orientation as they are conveyed along the two tracks, the articles extending beyond the scanned area of the beam, resulting in non-uniform irradiation of the articles.

Similarly, where small articles dispersed on an elongated carrier which has a length L greater than the scan width B of the beam, conveying the carrier cross-wise through the beam, i.e. relatively parallel with the beam scan width, could result in articles or portions thereof supported along the edges of the carrier to be unexposed or less exposed to the radiation.

The prior technology in general has not confronted the problem of conveying articles which cover a length longer than the scan width of an irradiation beam through such a beam. Moreover, the prior technology does not confront this problem in the context of a conveyor system intended to make best use of processing plant space.

SUMMARY OF THE INVENTION

In accordance with the invention, a conveyor system is provided which allows an irradiation beam of a given width to uniformly irradiate an elongated article supported on a carrier which is suspendable between the two tracks.

Further, the invention has as an object the uniform irradiation of an elongated article or a plurality of articles supported on a carrier, where the article or articles extend cross-wise beyond the area covered by the source of the irradiation.

Still further, the invention has as an object (a) improved use of space and (b) construction economy in an irradiation processing environment. That is, reducing required shielding, providing considerable floor space accessibility, and providing for easy transport of articles from place to place are achieved by the invention.

In realizing various of the above objects, one embodiment of the present invention provides that the carriers which support the article or articles, be reoriented as they approach the beam so that the length of the articles becomes more aligned with the direction of travel of the article. That is, the carriers are both suspendable between two tracks and rotatable to permit the carriers to be oriented at different angles relative to the direction of carrier travel along the two tracks. As the carrier advances along the two tracks to pass through the beam it is orientated into closer alignment with the direction of carrier travel to permit coverage by the beam of the entire length of the article, whereas at other positions along the path of travel the carriers may extend perpendicular to the direction of travel in a side-by-side relationship to achieve close grouping for space efficiency or other purposes related to processing.

Also in realizing various of the above-noted objects, the invention provides for orienting successive adjacent carriers in side-by-side relationship or in end-to-end relationship along various portions of the path of travel of the carriers. Specifically, carriers can travel (a) suspended from a monorail in end-to-end fashion, or (b) suspended from the two tracks (i) in side-by-side fashion or (ii) with carriers passing through the beam being oriented to a predefined angle relative to the direction of carrier travel along the two tracks. This permits enhanced use of space, full exposure of elongated articles to irradiation from a beam of limited width, and noninterference between the conveyor system and the beam.

Moreover, the present invention permits elongated carriers to enter a room containing an irradiation beam (e.g. an electron beam) in end-to-end fashion through narrow passage-ways and a small entranceway--which reduces leakage and shielding requirements and allows building dimensions to be reduced as well. When in the room, the carriers are directed onto a two track conveyor with the carriers being then directed into a side-by-side relationship. As a carrier suspended from the two tracks approaches the beam--which is between the two tracks--the carrier is reoriented to more closely align its length with the direction of carrier travel. Of similar effect, the carrier may be reoriented so that its length and/or the length of the article thereon forms a large angle, e.g. 90°, with the width of the beam. This permits articles supported along the length of the carrier to be fully and uniformly irradiated by a beam of width less than the lengthwise extent of the articles. Upon leaving the beam, the carriers are again oriented into a side-by-side relationship and thereafter directed onto another overhead monorail to exit the room, if desired.

DESCRIPTION OF A PREFERRED EMBODIMENT

Figure 1:
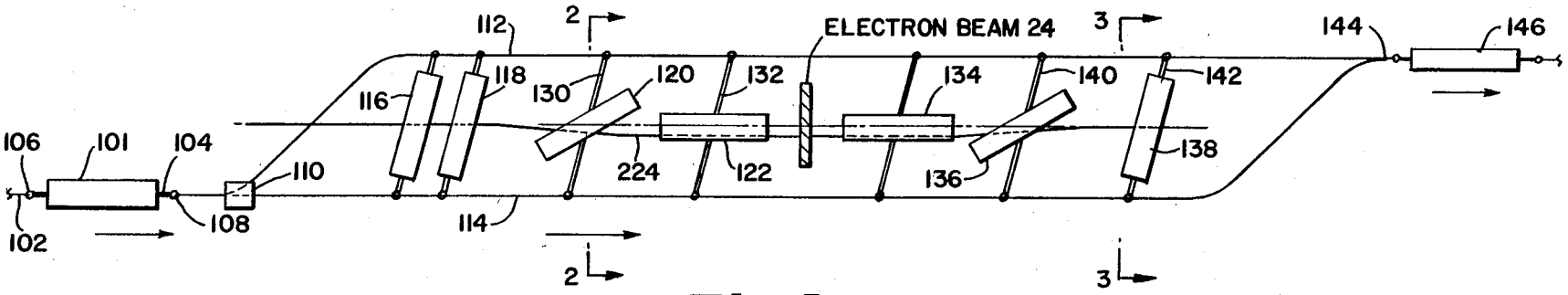
FIG. 1 is a top view illustration of carriers being conveyed to and from an irradiation beam according to the invention.

In FIG. 1, a carrier 100 is conveyed along an overhead monorail 102. Preferably, the carrier 100 is rectangular in shape having walled edges. Articles 101 are supportable on the carrier 100. The carrier 100 is moveable in the direction shown along the monorail 102. In operation, a plurality of carriers (see FIG. 4) are arranged in end-to-end sequence following a path defined by the monorail 102. The monorail 102 preferably extends through a small passageway and is capable of following a curved or straight path as required. This is a significant advantage where carriers are transported over somewhat labyrinthine paths enroute to a chamber whereat articles on the carriers are to be exposed to irradiation.

Carrier 100 is suspended from the monorail 102 by a suspension member 104. The suspension member 104 has a trolley element 106, 108 at each end, each trolley element 106 and 108 rolling along the monorail 102.

The carrier 100 moves in the direction shown until it reaches a toggle switch 110 which directs the leading trolley element 108 onto a first overhead track 112 and the trailing trolley element 106 onto a second overhead track 114 parallel to track 112. The carriers 116 and 118 are two adjacent carriers which have been directed onto the two tracks 112 and 114 from the monorail 102. Carriers 116 and 118 are in a side-by-side relationship.

As carriers 120 and 122 move toward an electron beam 124, it is noted that the carriers 120 and 122 reorient relative to their respective suspension members 130 and 132. Carrier 122 is in fact aligned with the direction of travel through the beam 124. Carrier 134 shows a carrier which has passed through the beam 24; carriers 136 and 138 are shown reorienting to align with the respective suspension members 140 and 142 thereof. To exit the chamber, the carriers again move onto a monorail 144, as shown by carrier 146, and are transported to a next location.

The carriers are advanced along monorails 102 and 144 and along the two tracks 112 and 114 by conventional mechanisms. For example, the carriers may be advanced by a chain drive (not shown).

Figure 2:
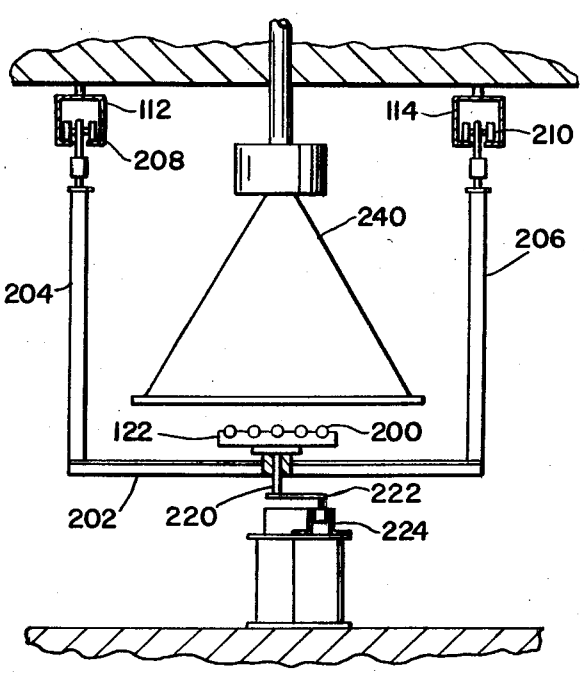
FIG. 2 is a side view of a carrier oriented in line with the direction of travel thereof as the carrier approaches an irradiation beam, FIG. II being taken along line 2—2 of FIG. 1.

Referring now to FIG. 2, the carrier 122 is shown with elongated articles 200 thereon. The carrier 122 (like the other carriers) is shown rotatably coupled to a cross-piece 202 extending between two downwardly extending arms 204 and 206. At the upward end of each arm 204 and 206 is a respective trolley element 208 and 210 which travels along the track 112 or 114, respectively. Preferably, the trolley elements 208 and 210 are chain-driven along the two tracks 112 and 114 (and along the monorail 102), although other mechanisms are also contemplated.

Extending downward from the carrier 122 is a rod 220 journalled in cross-piece 202. A lever 222 extends from the rod 220 and travels along a floor-mounted guide rail 224. (Guide rail 224 is also shown in FIG. 1.) As a carrier moves along a length of the two tracks 112 and 114, the lever thereof enters the guide rail 224 and effectuates a pivoting of the rod and the carrier affixed thereto about the rod axis.

Figure 3:
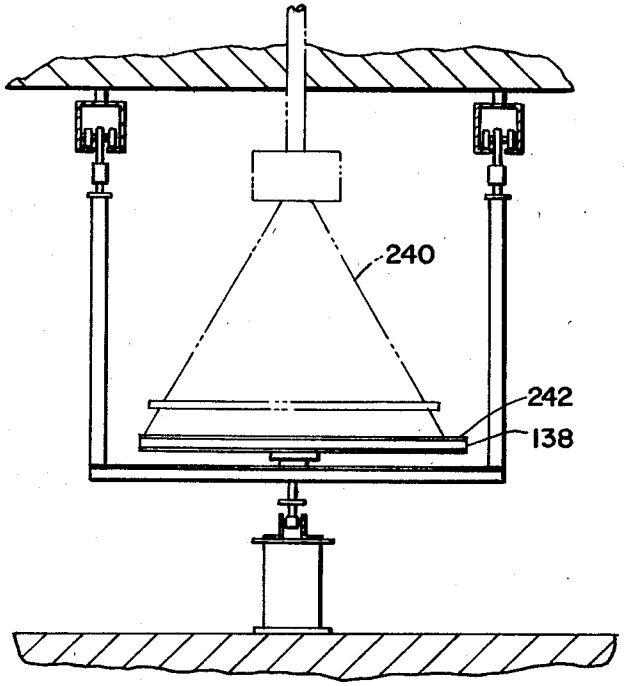
FIG. 3 is a side view of a carrier oriented transverse to the direction of travel thereof, FIG. III being taken along line 3—3 of FIG. 1.
Figure 4:
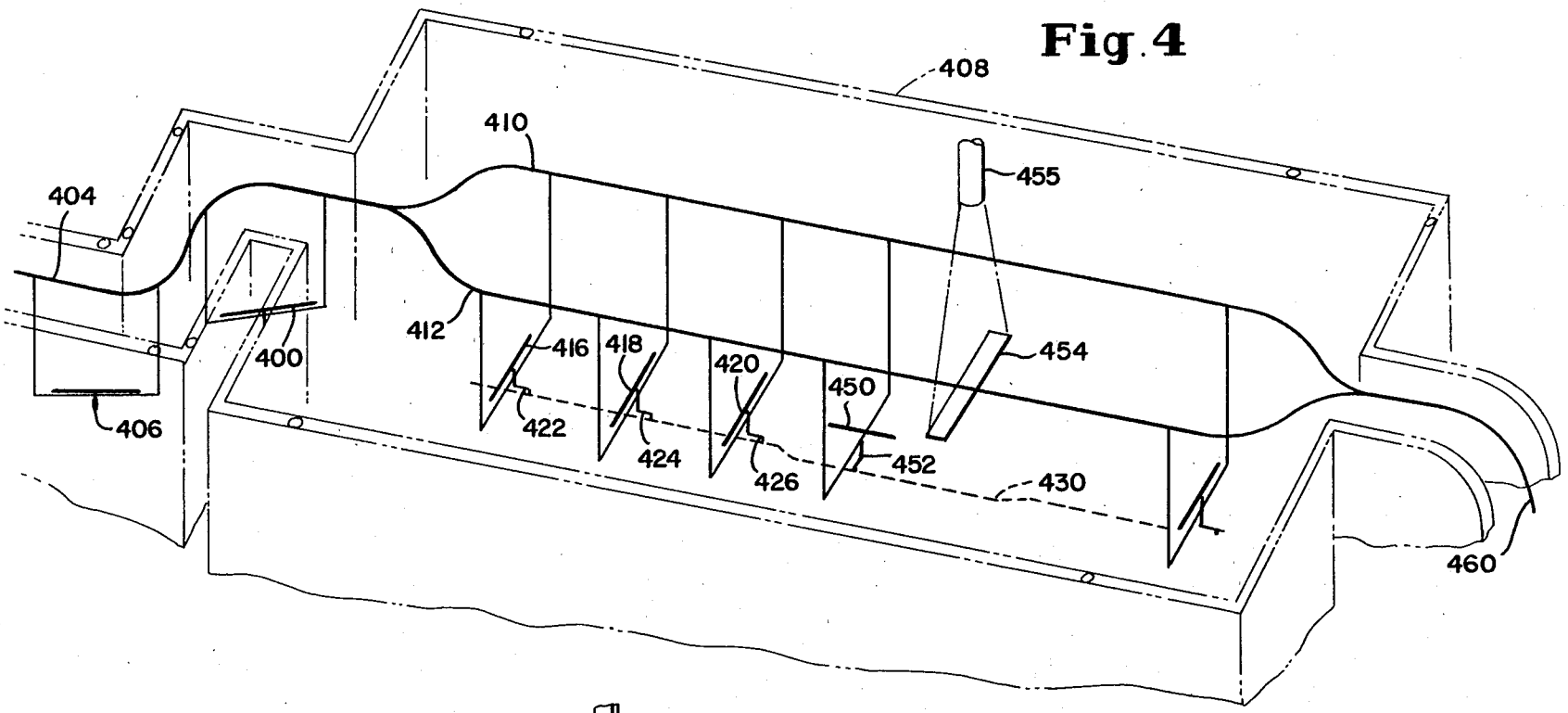
FIG. 4 is a perspective view illustrating a conveyor apparatus according to the invention.

The effect of rotating the carriers is shown with reference to FIGS. 2, 3 and 4. FIG. 2 shows the carrier 122 aligned with the direction of travel. The length of the carrier 122 and the articles 200 thereon are substantially perpendicular to the scan width of an electron beam scanner 240 which directs a beam of irradiation downward.

In FIG. 3, carrier 138 is shown transverse to the direction of travel. The length of an article 242 thereon extends beyond the scan width of the beam emanating from the scanner 240. Had the carrier 138 been sent past the scanner 240 in its illustrated orientation, non-uniform irradiation would result, with the edges of the article 242 being substantially unexposed.

Similarly, were smaller articles supported at various positions extending the length of the carrier 138, some of these articles at the ends of the carrier 138 would not be exposed to irradiation or at least to uniform irradiation.

Such non-uniform irradiation is obviated by the invention in that the carriers are oriented as shown in FIG. 2 as they pass through the area covered by the beam 124.

In reviewing the FIGS. 1, 2 and 3, it is noted that the articles supported on the carriers are shown to be elongated tubes or pipes of plastic or some other radiation processable material. As previously suggested, the invention also applies to articles of other structures and may apply as well to a single elongated article on a carrier. Moreover, although comprising a rectangular tray, the carrier may have any of varying sizes and designs, provided that (a) the carrier be rotatably pivotable relative to the suspension member and (b) the carrier can support articles which, in one direction, extend beyond the scan width of the irradiation beam.

In FIG. 4, carriers 400 and 402 are shown being conveyed along a monorail 404 which follows a passageway 406 to the shielded irradiation room 408. The carriers 400 and 402 are end-to-end and switch to side-by-side relationship as they advance in the direction shown by the arrow onto the two tracks 410 and 412. Carriers 416, 418, and 420 relatively closely grouped. The respective levers, 422, 424, and 426 of these carriers 416, 418 and 420 follow a floor-mounted track 430. The track 430 defines a path such that the levers 422, 424, and 426 maintain the respective carriers in cross-wise orientation. Referring now to carrier 450 it is noted that the lever 452 coupled thereto is in an angularly adjusted position because of the change in path of track 430 proximate to the beam 454 from source 455. That is, the carrier 450 passes through the beam with the angle between (a) the length over which the articles (not shown) extend and (b) the beam width—the "exposure" angle—is substantially a right angle. After exiting from under the beam, the carrier can be again positioned in close grouping along the two tracks 410 and 412 and directed onto a monorail 460 for end-to-end travel out from the room 408.

Figure 5:
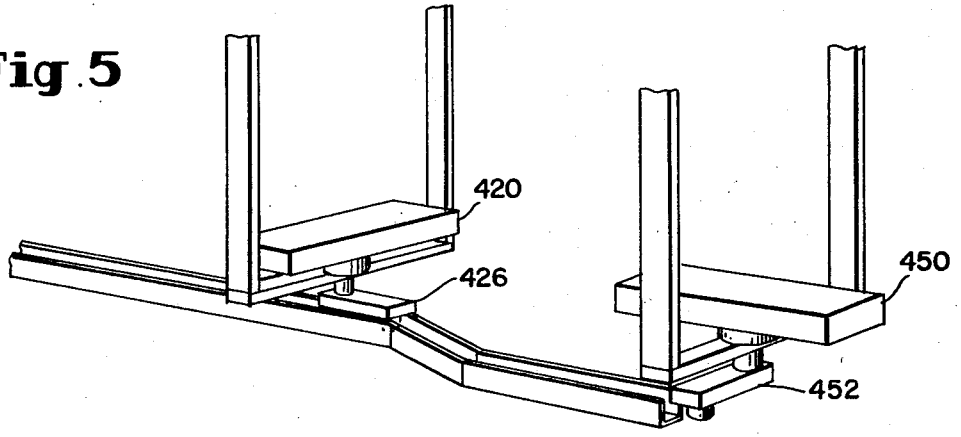
FIG. 5 is a detailed view of part of FIG. 4.

FIG. 5 shows carriers 420 and 450 and their respective levers 426 and 452 in detail.

Other improvements, modifications and embodiments will become apparent to one of ordinary skill in the art upon review of this disclosure. Such improvements, modifications and embodiments are considered to be within the scope of this invention as defined by the following claims.

I claim:

1. Apparatus for conveying articles through an irradiation beam having a width B to irradiate the articles, the apparatus comprising;

a. a suspension member for supporting a carrier, said suspension means having a length L which substantially exceeds the beam width B, b. a carrier for carrying at least one article to be irradiated, said carrier being pivotally connected to said suspension member and adapted to rotate relative thereto, c. means for guiding and conveying said suspension means along a selected path which intersects the irradiation beam at a given angle relative to the plane of scan of the beam, said last mentioned means being connected to said suspension member and including a means permitting the suspension member to be reoriented relative to its direction of travel along the path, and d. means for pivoting said carrier relative to said suspension member to change the angle between said plane and said carrier to an angle lying between said plane and said given angle.

2. Apparatus as claimed in claim 1 further comprising, means for insuring uniform exposure to the beam of an article on said carrier, said means for insuring uniform exposure causing said mean for pivoting to rotate said carrier as it is conveyed through the beam sufficiently to change the exposure angle of said carrier to the beam.

3. Apparatus according to claim 2 wherein the pivotal axis of said suspension means is coaxial with the central axis of the beam.

4. Apparatus as claimed in claim 2, wherein the means for guiding and conveying comprises:

two parallel tracks with the beam width extending cross-wise therebetween, two trolleys, each trolley travelling along a corresponding one of the two tracks and each trolley being coupled to one end of the suspension means; and said carrier being disposed substantially horizontally and being rotatable about a substantial vertical axis.

5. Apparatus as claimed in claim 4, wherein said pivoting means includes:

a rod extending from said carrier along the vertical axis of carrier rotation and (b) journalled within said suspension means;

a lever having a first end connected to said rod and a second end disposed radially outward from the rod;

a third track; and means, for guiding the second end of the lever along said third track;

said lever, said rod, and said carrier being rotated about the vertical axis of carrier rotation responsive to said second end of said lever following the path defined by said third track.

6. Apparatus for conveying elongated articles, each article having a length L, through an irradiation scan beam having a scan width B where B is less than L, the apparatus comprising:

a plurality of carriers, each carrier being adapted to support at least one elongated article in a fixed position relative thereto means for supporting each said carrier;

each said carrier being pivotally connected to said means for supporting and independently pivotable relative thereto, first means for conveying said carriers for a first distance along a path substantially perpendicular to the scan width, such that an elongated article on said carrier is disposed parallel to the direction of carrier advancement;

second means for conveying said carriers for a second distance along a path wherein said carriers are oriented and travel in a direction transverse to the scan width, means for reorienting each carrier to more closely align an elongated article thereon transverse to the direction of carrier advancement said means for reorienting being responsive to said each carrier being conveyed beyond said first distance and proximate to exposure of the at least one article to the beam;

an elongated article on said reoriented carrier being thereby more uniformly exposed to irradiation along the length L thereof.

7. Apparatus as claimed in claim 6, wherein said means for conveying comprises:

two parallel tracks with the beam width extending cross-wise therebetween;

(a) two trolleys, each trolley adapted to travel along a corresponding one of the dual tracks and each trolley being coupled to one end of the supporting means which is suspended therefrom; and where each carrier is disposed substantially horizontally and being rotatable about a substantially vertical axis.

8. Apparatus as claimed in claim 7, wherein said each carrier reorienting means includes:

means for rotating said carrier relative to said suspending means responsive to said carrier being advanced along said guide means to pass under the beam.

9. Apparatus as claimed in claim 8, wherein said each carrier rotating means includes:

a rod (a) extending from said carrier along the vertical axis of carrier rotation and (b) journalled within the suspension member;

a lever having a first end connected to said rod and a second end disposed radially outward from the rod;

a third track; and means for guiding the second end of the lever along said third track;

said lever, said rod, and said each carrier being rotated about the vertical axis of carrier rotation responsive to said second end of said lever following the path defined by said third track.

10. Apparatus as claimed in claim 7, wherein each suspension member includes:

two substantially vertically disposed arms and a substantially horizontal cross-piece extending between the lower ends of said arms;

the upper end of each arm being coupled to one of the two trolleys; and said carrier being rotatably coupled to said cross-piece.

11. Apparatus as claimed in claim 10, wherein said each carrier rotating means includes:

a rod (a) extending from said carrier along the vertical axis of carrier rotation and (b) journalled within the suspension member;

a lever having a first end connected to said road and a second end disposed radially outward from the rod;

a third track; and means for guiding the second end of the lever along said third track;

said lever, said rod, and said each carrier being rotated about the vertical axis of carrier rotation responsive to said second end of said lever following the path defined by said third track.

12. Apparatus as claimed in claim 6, wherein the guide for conveying comprises:

at least one monorail;

two substantially parallel tracks of fixed lengths, the beam being positioned therebetween; and for each carrier (a) a suspension means having two ends; (b) two trolleys, each trolley being affixed to one end of said suspension means; (c) means for rotatably coupling with each carrier (i) having a substantially horizontal surface on which the at least one article is supported and (ii) being rotatable about a substantially vertical axis; and (d) means for selectively positioning the two trolleys (i) in-line along one monorail or (ii) side-by-side with each trolley travelling along one of the two tracks.

13. Apparatus as claimed in claim 12, further comprising:

means for directing carriers from an end-to-end relationship on a first monorail to a side-by-side relationship along said two tracks;

each successive carrier directed onto the two tracks being reoriented thereon from a transverse position relative to the direction of carrier advancement to a substantially aligned position relative to the direction of carrier advancement responsive to said carrier approaching the beam.

14. Apparatus for conveying articles through an electron beam having a width B, the apparatus comprising:

a first elongated carrier having a length L which substantially exceeds B;

an elongated support means for supporting said carrier, said carrier being pivotally connected to said, suspension means and independently pivotable relative thereto;

two parallel tracks having the beam therebetween, said suspension means being suspended from and between the two tracks;

means for advancing said first carrier and suspension means along a path (a) transverse to the width dimension of the beam and (b) which passes under the beam; and means for reorienting said first carrier so that the longitudinal axis of said first carrier is oriented (a) transversely relative to the direction of advancement of said first carrier over a first distance and (b) substantially aligned with the direction of advancement of said first carrier, responsive to said first carrier being advanced to enter toward under the beam after said first distance.

15. Apparatus as claimed in claim 14, wherein the reorienting means further includes:

means for returning said first carrier to a transverse orientation relative to the direction of advancement of said first carrier responsive to said first carrier exiting from under the beam.

16. Apparatus as claimed in claim 15, further comprising:

additional elongated carriers identical to said first carrier, said first carrier and said additional carriers representing successive carriers that are similarly advanced and reoriented along a common path.

17. Apparatus as claimed in claim 16, further comprising:

a first monorail along which carriers of said successive carriers travel in end-to-end fashion; and means for directing carriers of said successive carriers from said first monorail onto said two tracks responsive to said successive carriers being advanced.

18. Apparatus as claimed in claim 17, further comprising:

a second monorail along which carriers of said successive carriers travel in end-to-end fashion;

means for directing said successive carriers on said two tracks onto said second monorail responsive to said successive carriers being advanced after passing through the beam.

19. Apparatus as claimed in claim 18, wherein said first carrier is rectangular in shape.

20. Apparatus as claimed in claim 14, wherein said first carrier is rectangular in shape.

* * * * *